United States Patent [19]

Hamilton

[11] 4,189,176

[45] Feb. 19, 1980

[54] LATCH BOLT ACCESSORY

[76] Inventor: William J. Hamilton, 1180 Woodroffe Ave., Ottawa, Ontario, Canada, K2C 2T3

[21] Appl. No.: 921,895

[22] Filed: Jul. 5, 1978

[51] Int. Cl.[2] ..... E05B 17/00; E05B 15/12

[52] U.S. Cl. ..... 292/346; 292/1; 292/153; 292/288

[58] Field of Search ..... 292/346, 288, 150, 153, 292/297, 298, 292, 1, DIG. 53, DIG. 54; 269/229, 287; 33/174.6; 70/416, 418

[56] References Cited

U.S. PATENT DOCUMENTS

| | | | |
|---|---|---|---|
| 191,994 | 6/1877 | Newell | 292/153 |
| 1,014,583 | 1/1912 | Eisenhart | 292/153 |
| 2,827,813 | 3/1958 | Totten | 269/287 X |
| 3,312,490 | 4/1967 | MacDonald | 292/346 X |
| 3,318,123 | 5/1967 | Piazza | 292/150 X |
| 3,773,369 | 11/1973 | Wersonick | 292/346 X |

*Primary Examiner*—William E. Lyddane

[57] ABSTRACT

For use with a reciprocating latch bolt or plunger having a transversely disposed slot, a thin elongate plate designed to fit in the usual space between the door edge and the frame and to engage in said slot to prevent the retraction of the latch bolt from the frame keeper, the latch bolt slot being of a width to accommodate the thickness of the plate. In a preferred embodiment the plate is made of 18 or 20 gauge sheet metal which is sturdy enough to restrain the retraction of the latch bolt yet thin enough to fit in the normal door-to-frame clearance dimension and on removal from the latch bolt to be carried in one's wallet or purse. The plate may be provided with a latch accommodating perforation near each end, with one of said perforations having a side opening thereto whereby the plate at this end is in the form of a hook, and each perforation has an inwardly extending projection or tab selectably engageable in said latch bolt slot. In this form the latch bolt accessory is possessed of maximum versatility being usable in both reversed end-for-end positions and even when inverted.

12 Claims, 8 Drawing Figures

LATCH BOLT ACCESSORY

BACKGROUND OF THE INVENTION

This invention relates to improvements in a latch bolt accessory and appertains particularly to a removable device that may be hung on an extended latch bolt in such manner as to prevent the retraction of the bolt prior to the displacement of the device.

SUMMARY OF THE INVENTION

It is known to provide means to stop the normal retraction of a bolt by the usual handle and to prevent disengagement of a bolt from its frame keeper on the insertion of some thin instrument between the door and frame worked against the bevel of the end of the bolt. These have been found to involve excessive remodelling of the latch structure or to offer less than the desired security.

Accordingly it is an object of this invention to provide a low-cost removable latch bolt accessory usable on various types of conventional latch bolts with only the simplest modification of the bolt.

It is a further object of the invention to provide a removable latch bolt accessory in the form of a thin flat plate applicable in various positions on the latch bolt that afford differing degrees of security.

A further object of the invention is to provide a latch bolt accessory that in at least one operable position hangs vertically from the latch bolt, concealed as is lies entirely within the door-to-frame dimension space.

A further object of the invention is to provide a portable latch bolt accessory that may be carried conveniently in a wallet or purse.

A still further object of the invention is to provide a method and means of modifying an existing conventional latch bolt for selective locking engagement by this accessory.

To accomplishment of and related objects as shall become apparent as the description proceeds, the invention resides in the construction combination and arrangement of parts as shall be hereinafter more fully described, illustrated in the accompanying drawings and pointed out in the claims hereinto appended.

BRIEF DESCRIPTION OF THE DRAWINGS

In the drawings forming a part of this disclosure wherein like characters indicate like parts throughout the several views.

DETAILED DESCRIPTION OF THE INVENTION

The removable latch bolt accessory disclosed herein that may be easily carried in a wallet or purse is usable on a variety of reciprocating latch bolts or plungers with only minimal modification of an existing bolt.

The embodiment of the accessory shown in the attached drawings consists of a thin flat plate 1 designed to be suspended on an extended latch bolt in the normal door-to-frame clearance space between the lock stile edge of the door and the confronting frame jamb. The plate accessory is versatile and may be positioned on the latch bolt in various ways as seen in FIGS. 3 to 6 inclusive.

Figure 1:
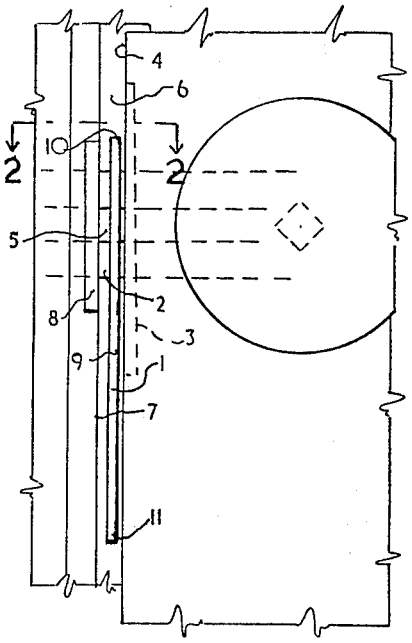
FIG. 1 is a front elevation of a part of a door and frame showing my latch bolt accessory in position.
Figure 2:
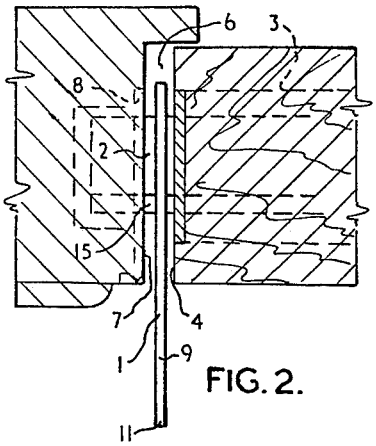
FIG. 2 is a horizontal section as taken on line 2—2 of FIG. 1.
Figure 3:
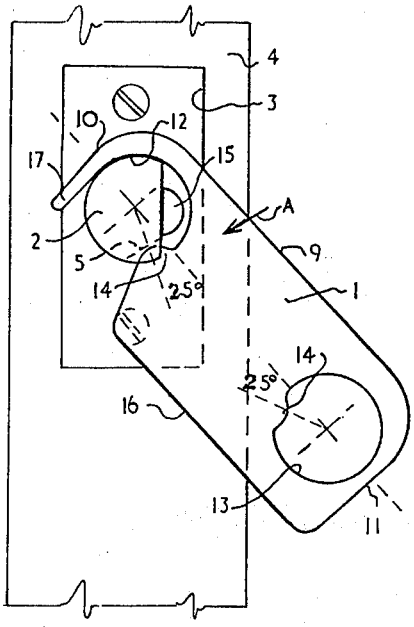
FIG. 3 is an elevation of the door edge showing the latch bolt accessory in one possible position.

In the side elevation and plan view seen in FIGS. 1 and 2, the latch bolt accessory 1 is suspended on the extended latch bolt 2 of a conventional mortise lock 3 set in the lock stile edge of a door 4. The flat plate 1 hangs at a downwardly inclined angle of approximately 45 degrees and in this position as shown in FIG. 3, engages in a shallow slot 5 cut in the under side of the latch bolts 2 at the inner edge and disposed at an angle of about 30 degrees to the horizontal. The clearance space 6 between the lock stile of the door 4 and the frame jamb 7 is usually more than adequate to accomodate the flat plate 1. Once suspended on the extended latch bolt 2 and rotated to engage in the bolt slot 5, the latch bolt cannot be retracted or withdrawn from the frame keeper 8 until the plate 1 is disengaged from the slot 5.

Referring now particularly to FIGS. 3 to 6 inclusive the plate accessory 1 is seen to comprise a thin elongate member of generally rectangular shape with one of its longer sides 9 unbroken and rounded at opposite ends 10 and 11 each encompassing a circular perforation or aperture 12 and 13 respectively of a diameter to accomodate the latch bolt 2. Each such aperture has an inward projection 14 in the form of a tab or lug, that on initial application of the plate 1 to the latch bolt 2 may nest under the dead lock 15 of the latch bolt 2 and on further movement in a direct line or partial rotation of the plate moves into the shallow slot 5 in which engagement it effectively precludes the retraction of the latch bolt.

The versatility of this latch bolt locking accessory is increased if the long side 16 of plate 1 opposite the side 9 near the rounded end 10 terminates short of the perforation 12 and extends angularly inwards at about 65 degrees to the tab 14 and the end 10 tapers slightly on its outer side as at 17 and stops short of the projection of side 16 in the form of a hook and affording an open entry gap to the aperture 12.

Figure 4:
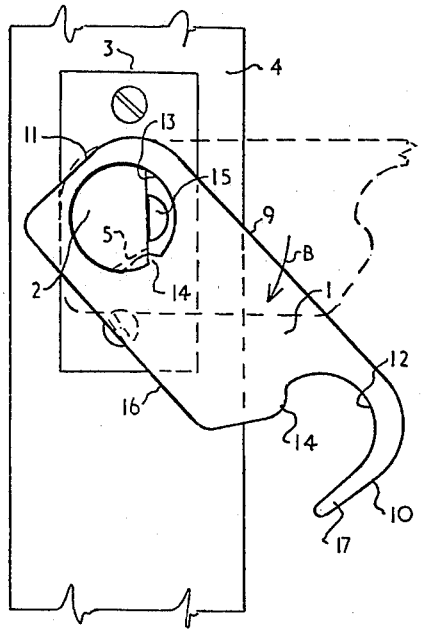
FIG. 4 is a similar elevation of the door edge showing the accessory applied to the latch bolt by its opposite end.

It will be noted, on reference to FIG. 3 that the inwardly projecting tabs 14 formed on the rims of perforations 12 and 13 are each disposed at an angle of approximately 25 degrees to the longitudinal median that passes through the centers to these perforations but with both tabs lying on the same side of said median. Thus either end of the plate may be used to engage the latch bolt 2 as shown in FIGS. 3 and 4, with the longer side 9 uppermost. In FIG. 3, the perforation 12 with its open gap and hooked end 17 may be applied in a direct line descending at about 30 degrees to the horizontal, as indicated by arrow A in which case the inwardly projecting tab 14 slides into the latch bolt slot 5 which as previously mentioned is cut at approximately this same angle.

To apply the plate as seen in FIG. 4, with the perforation 13 completely encircling the bolt, the door is closed and the latch bolt 2 is retracted into the door as by turning the handle whereupon the plate is inserted in the horizontal position shown in dotted outline between the door and frame where the perforation 13 is aligned with the latch bolt that is then released, whereupon the plate is allowed to rotate downwardly through 45 degrees as indicated by arrow B to bring its tab 14 into the latch bolt slot 5.

Figure 5:
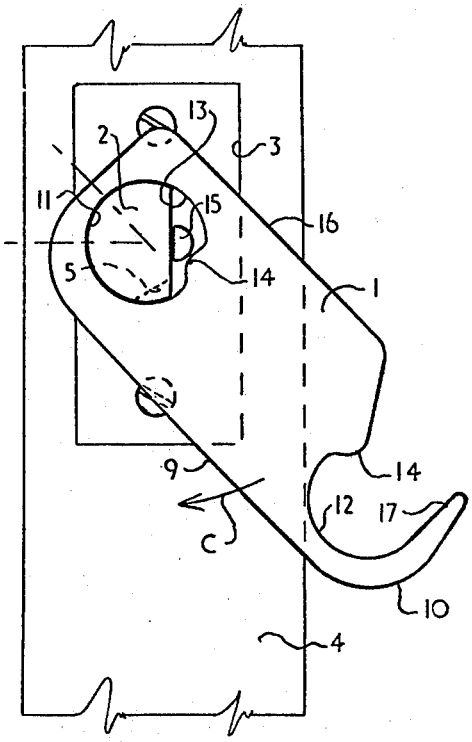
FIG. 5 is a view similar to FIG. 4 but with the accessory inverted for application so that when rotated into locking engagement with the latch bolt it lies concealed in vertical position between the door edge and frame.
Figure 6:
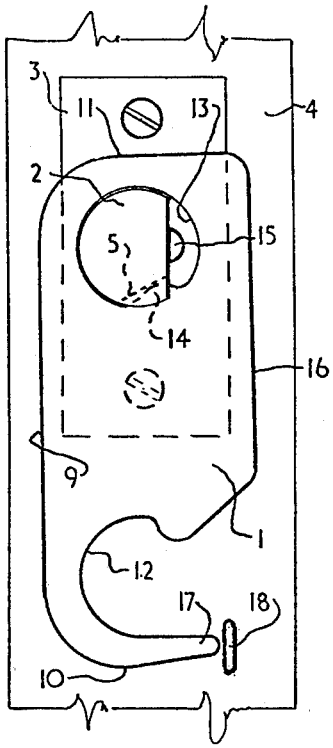
FIG. 6 is an elevation of the accessory applied in the position shown in FIG. 5 but provided with a holding staple for greater security.
Figure 7:
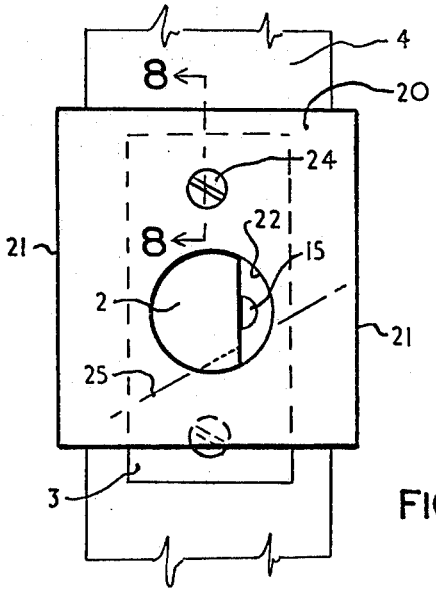
FIG. 7 is an elevation of a shield plate for use in slotting the latch bolt.

In the positions shown in FIGS. 5 and 6 the plate 1 is inverted placing the side 16 uppermost but declining at an angle of about 45 degrees because of the changed relative position of tab 14. In this inverted but angular incline, the bolt encircling perforation 13 is fed onto the latch bolt by retracting the bolt and aligning the perforation with the bolt 2 as previously explained. In this position the plate 1 is then rotated as indicated by arrow C through 45 degrees into locking position in a normal vertical suspension, see FIG. 6, where it lies concealed between the door and frame. The plate may be easily retrieved and the latch bolt released on the reverse rotation of the plate by the insertion of an ordinary key inserted under the plate, with its serrations uppermost, and drawing the same out. Greater security is obtained if the plate is used as just described and a small staple 18 is driven into the door edge 4 in a position to confront the tapered end of hook 17 barring the easy reverse rotation of plate 1 as seen in FIG. 6. When employing this capturing staple the hook tip is first given a slight lateral bend at 10, moving the tip section 17 towards the door edge 4. The plate is then swung into its vertical position but because of the bent tip, will resist insertion into the door-to-frame space, requiring a push with a key or coin until the hook tip 17 is back beyond the staple 18 where it should snap against the door as it passes the staple. If, because the door-to-frame spacing is large or the angular slot was cut too far from the door edge 4, the hook tip still does not make good contact after bending at 10, a slight lateral bend of the thin ring section 11 towards the door edge 4 will produce the desired result. Either adjustment uses the plate tab-in-slot as a fulcrum to maintain hook tip 17 contact with the door edge 4, thereby insuring that the hook tip will enter the staple if removal is attempted from the outside. To release the plate 1 from this staple-held position requires first that the plate be swung back until the hook end clears the staple and may further require the insertion of a thin tool such as a nail file to bend the hook end away from the door so that it can be retracted over the staple.

When the plate 1 hangs in vertical operable position, as seen in FIG. 6, it lies entirely within the door-to-frame space with no part projecting beyond the face of the door into the room, being thus effectively concealed—or unobserved. In such a case, if there is a window in the door that is broken and through which a would-be thief reaches in to turn the knob he finds it frozen and with no projecting part of the plate, as in FIGS. 3 and 4, to touch or manipulate he is frustrated and foiled.

Though the plate 1 may be made of various materials, I prefer sheet metal of 18 or 20 gauge having in mind that for adjustment due to wear or poor fit it may be desired to bend the hook end 10 circumferentially or laterally or to narrow the thin ring between the end 11 and the perforation 13 to enable the same to be bent in radially to assure that sufficient depth of the respective tab 14 seats in the latch bolt slot 5.

Figure 8:
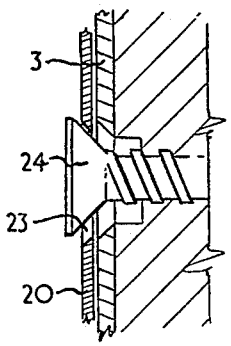
FIG. 8 is an enlarged sectional detail illustrating the wedging action of the shield plate caused by the fastening screw.

To adapt a conventional mortise lock 3 for use of this accessory the only modification needed is to cut the slot 5 in the latch bolt 2. The slot is cut with a hack saw, on the underside inclining upwards toward the inner edge at about 30 degrees and close to the door. A shield plate 20 is available for this slotting being of spring steel and rectangular in shape a little wider than the door edge with its opposite sides 21 rounded back from the cutting plane. There is a central perforation 22 of a size and shape to freely accomodate the latch bolt 2 and a smaller tapered opening 23 spaced vertically thereabove for near axial alignment with the mortise lock face plate screw hole. The mortise lock face plate upper screw 24 is removed and when the shield plate 20 is threaded on the latch bolt 2, the center of the tapered opening 23 lies approximately one sixteenth of an inch below the axis of the mortise lock face plate screw hole as will be seen clearly in FIG. 8. When the screw 24 is reinserted in its screw hole and tightened the conical head thereof presses upwards on the slightly downwardly offset opening 23 of the shield plate 20 causing the plate to rise and its perforation 22 to bind tightly on the underside of the latch bolt 2 holding it steady for cutting. The shield plate 20 may be marked as at 25 to indicate the angle and the depth of the slot to be cut. By this method, the shield plate provides: (1) positioning of slot from door edge 4, (2) means of holding bolt, securely, (3) the 30° angle guideline for cutting, (4) protection for the door against abrasion from the saw blade.

From the foregoing description taken in conjunction with the attached drawings of a preferred form of my latch bolt accessory, it will be apparent to those skilled in the art to which this invention appertains that this embodiment is susceptible to modification, variation and change without departing from the proper scope or fair meaning of the appended claims.

I claim as my invention:

1. In combination with a reciprocating latch bolt of a door, the bolt having a transversely extending slot cut therein, a free and portable thin flat member including suspension means for rotatably suspending said member on said bolt when said bolt is extended and latch means to engage in said slot to prevent retraction of said bolt.

2. The device according to claim 1, wherein said member is an elongate plate with said suspension means comprising a perforation near one end thereof of a size to pass the latch bolt and said latch means comprises a projection on said plate extending inwardly into said perforation and movable on rotation of said plate on said latch bolt into engagement with the slot in said bolt.

3. The device according to claim 2, wherein the thin flat member has at least one latch bolt-passing perforation and said member is an elongate metal plate of thickness of approximately 20 gauge and constructed so that a selected part of the plate in the area of the bolt-passing perforation may be bent laterally towards the door.

4. The device according to claim 2, wherein the slot in said latch bolt is a transversely extending slot cut in the underside thereof inclining upwards at the inner edge to lie at about 30 degrees to the horizontal and being close against the door edge when said bolt is extended, and wherein said thin flat plate member is sturdy enough that the inwardly extending projection when engaged in the slot in said latch bolt will prevent the retraction of said bolt.

5. The device according to claim 4, wherein said elongate plate has a latch bolt-passing perforation near each end, each perforation having an inwardly extending projection selectably engagable in the latch bolt slot, one of said perforations having a side opening thereto caused by terminating one of the longer sides of the elongate plate short of the perforation and extending it angularly at about 65 degrees to the perforation to provide an open gap and a hook end, wherein said open gap is a width to pass the slotted latch bolt when said plate is applied in a direct line to the latch bolt at an angle of about 30 degrees to the horizontal, i.e. approximately parallel to the angle of incline of the slot in the latch bolt.

6. The device according to claim 5, wherein the plate in the areas of the perforation may be bent laterally towards the door to maintain the hook end in contact with the door as the projection is engaged in the slot of the latch bolt, and wherein the device is further provided with a capturing staple to be positioned on the door to releasably engage the hook end when the projection is in engaged position in the slot.

7. The device according to claim 4, wherein said elongate plate has a perforation near each end, each of a size to pass the latch bolt and each with an inwardly extending projection, one of said perforations having a side opening thereto whereby that end of the plate may be simply inserted in the door-to-frame clearance dimension in a direct line at approximately the same angle as the latch bolt slot to hook on the extended latch bolt and be solely suspended thereby for rotation relative thereto and cause the projection in said open side perforation to engage in the latch bolt slot.

8. The device according to claim 7, wherein said perforation has an inwardly extending projection engagable in the latch bolt slot and wherein selected parts of the plate in the area of either perforation may be bent in radially to ensure sufficient depth of penetration of said projection in said slot.

9. The device according to claim 1, wherein the thin flat member is an elongate metallic plate with said suspension means comprising a latch bolt-passing perforation near each end, said latch means comprising a projection on said plate extending inwardly into each said perforation and selectably engagable with the transverse slot in the latch bolt, said projections being at an angle of approximately 25 degrees to the longitudinal median of the plate that passes through the centers of said perforations, whereby the plate is engagable on the latch bolt in reversable end-to-end relation and also in inverted relation.

10. The device according to claim 9, wherein one of said perforations has a side opening caused by terminating one of the longer sides of said elongate plate short of the perforation and extending it angularly at about 65 degrees to meet the perimeter of the perforation at its respective inwardly extending projection providing the plate with an open gap perforation and a hooked end allowing the plate to be applied directly to an extended latch bolt in a straight line declining at an angle of about 30 degrees, allowing the plate to be reversed end-for-end and applied in horizontal position to the latch bolt by retracting the bolt and aligning the other perforation with the latch bolt and releasing said bolt and rotating the other end downwardly through approximately 45 degrees, and allowing the plate to be inverted and applied in a downwardly inclined position when said last mentioned perforation is likewise engaged on the latch bolt and the plate is downwardly rotated into vertical position where it lies concealed in the normal door-to-frame space.

11. The method of securing the latch bolt of a door from being retracted comprising the steps of cutting a transverse slot in the underside of the latch bolt wherein said slot inclines upwardly towards its inner side at an angle and is disposed close to the lock stile of the door, applying to said slotted bolt a thin flat member having suspension means for rotatably suspending said member on said bolt and latch means to engage in said slot to prevent retraction of the bolt, and moving said member to cause same said latch means to engage in said slot.

12. The method of claim 11 wherein the cutting of the transverse slot is achieved by applying to the lock stile edge of a door a thin shield plate perforated to pass the latch bolt, securing said shield tightly in place to cause the same to bind on the under side of the latch bolt to hold the bolt steady for cutting, and sawing said slot at an angle and to a depth clearly marked on said shield plate.

* * * * *